US006059707A

United States Patent [19]

Belias et al.

[11] Patent Number: 6,059,707

[45] Date of Patent: May 9, 2000

[54] EASY TO OPEN HANDLE BAG AND METHOD OF MAKING THE SAME

[75] Inventors: William P. Belias, Pittsford; Robert T. Maddock, Ionia, both of N.Y.

[73] Assignee: Tenneco Packaging Inc., Lake Forest, Ill.

[21] Appl. No.: 09/049,402

[22] Filed: Mar. 27, 1998

[51] Int. Cl.[7] ..... B31B 1/64

[52] U.S. Cl. ..... 493/198; 493/195; 493/255; 493/267; 493/342; 493/926

[58] Field of Search ..... 493/198, 194, 493/195, 243, 255, 267, 342, 926

[56] References Cited

U.S. PATENT DOCUMENTS

| | | | |
|---|---|---|---|
| Re. 33,264 | 7/1990 | Baxley et al. | 206/554 |
| 209,749 | 11/1878 | Brown . | |
| 277,153 | 5/1883 | Onderdonk . | |

(List continued on next page.)

FOREIGN PATENT DOCUMENTS

| | | |
|---|---|---|
| 931406 | 8/1973 | Canada . |
| 1138851 | 1/1983 | Canada . |
| 0016601 | 3/1980 | European Pat. Off. . |
| 0117730A2 | 5/1984 | European Pat. Off. . |
| 0423729A2 | 4/1991 | European Pat. Off. . |
| 43930 | 3/1971 | Finland . |
| 1055074 | 2/1954 | France . |
| 1120408 | 4/1956 | France . |
| 1341587 | 8/1963 | France . |
| 1342346 | 9/1963 | France . |
| 1409321 | 6/1964 | France . |
| 2302865 | 10/1976 | France . |
| 242982 | 1/1980 | France . |
| 2469355 | 5/1981 | France . |
| 61848 | 11/1905 | Germany . |
| 155589 | 8/1956 | Germany . |
| 1133667 | 7/1962 | Germany . |
| 277176 | 5/1963 | Germany . |
| 273796 | 8/1969 | Germany . |
| 1809659 | 7/1970 | Germany . |
| 2326524 | 3/1974 | Germany . |
| 2442715A1 | 3/1976 | Germany . |
| 2526961 | 5/1976 | Germany . |
| 2554395A1 | 6/1977 | Germany . |
| 2924106A1 | 12/1980 | Germany . |
| 60617 | 1/1948 | Netherlands . |
| 108890 | 6/1964 | Netherlands . |
| 7906246 | 8/1979 | Netherlands . |
| 694695 | 7/1953 | United Kingdom . |
| 827383 | 2/1960 | United Kingdom . |

(List continued on next page.)

*Primary Examiner*—Brian L. Johnson
*Assistant Examiner*—Matthew Luby
*Attorney, Agent, or Firm*—Jenkens & Gilchrist P.C.

[57] ABSTRACT

A method of forming a plurality of easy to open handle bags including the steps of providing a flattened tube of thermoplastic material oriented in a generally longitudinal direction. The flattened tube has a first longitudinal side edge and a second longitudinal side edge, a transverse lower heat seal, and a transverse upper heat seal. The tube also has first, second, and third sections. The second section being disposed between the first and third sections. The first section is joined to the second section along a generally longitudinal first fold line. The second section is joined to the third section along a generally longitudinal second fold line. The second section is cut along a generally transverse first cut line extending between the first and second fold lines. The first section is folded over the second section along the first fold line. The third section is folded over the previously folded-over first section along the second fold line such that the first, second, and third sections overlap one another. The overlapped first, second, and third sections are cut along a generally longitudinal second cut line that intersects the first cut line, the first fold line, and the second side edge at one end and intersects the upper heat seal at the other end. The overlapped first, second, and third sections are then cut along a generally longitudinal third cut line that intersects the first cut line, the second fold line, and the first side edge at one end and intersects the upper heat seal at the other end.

38 Claims, 5 Drawing Sheets

U.S. PATENT DOCUMENTS

| | | | |
|---|---|---|---|
| D. 297,113 | 8/1988 | Beniot | D9/305 |
| D. 302,112 | 7/1989 | Beniot | D9/305 |
| 328,888 | 10/1885 | Hunt . | |
| 341,720 | 5/1886 | Bayle . | |
| 447,686 | 3/1891 | Holladay . | |
| 558,291 | 4/1896 | Lunham . | |
| 769,295 | 9/1904 | Beltz . | |
| 868,504 | 10/1907 | Taylor . | |
| 1,403,751 | 1/1922 | Edstrom . | |
| 1,424,690 | 8/1922 | Syers . | |
| 1,453,200 | 4/1923 | Stacho . | |
| 1,663,391 | 3/1928 | Shaffer et al. . | |
| 1,679,450 | 8/1928 | Thompson . | |
| 1,799,537 | 4/1931 | Schindler . | |
| 1,971,642 | 8/1934 | Champlin | 83/26 |
| 2,071,362 | 2/1937 | Rowe | 229/55 |
| 2,095,067 | 10/1937 | Kirk | 229/55 |
| 2,126,203 | 8/1938 | Miskella | 229/62 |
| 2,162,113 | 6/1939 | Noffsinger | 248/100 |
| 2,170,945 | 8/1939 | Greene | 93/35 |
| 2,294,220 | 8/1942 | Albertson | 93/3 |
| 2,320,326 | 5/1943 | Avery | 93/18 |
| 2,412,066 | 12/1946 | Shear | 164/29 |
| 2,432,122 | 12/1947 | Pardee | 93/36.8 |
| 2,648,512 | 8/1953 | Scholin | 248/100 |
| 2,673,024 | 3/1954 | Kuss | 229/57 |
| 2,689,594 | 9/1954 | Wendt | 150/1 |
| 2,815,186 | 12/1957 | Miller | 248/99 |
| 2,819,834 | 1/1958 | Brady | 229/53 |
| 2,871,771 | 2/1959 | Mercer | 93/35 |
| 2,915,098 | 12/1959 | McKay | 150/5 |
| 3,048,069 | 8/1962 | Berlin et al. . | |
| 3,064,652 | 11/1962 | Corcoran et al. | 128/272 |
| 3,111,677 | 11/1963 | Artzt | 2/84 |
| 3,119,548 | 1/1964 | Cook et al. | 229/53 |
| 3,125,281 | 3/1964 | Woolen | 229/63 |
| 3,125,548 | 3/1964 | Anderson | 260/45.5 |
| 3,133,691 | 5/1964 | Corbett | 299/53 |
| 3,142,437 | 7/1964 | Grant et al. | 229/68 |
| 3,143,277 | 8/1964 | LaFleur | 229/57 |
| 3,154,238 | 10/1964 | Barnhill | 229/55 |
| 3,176,052 | 3/1965 | Peticolas | 260/897 |
| 3,180,557 | 4/1965 | Thulin | 229/54 |
| 3,204,760 | 9/1965 | Whiteford | 206/46 |
| 3,204,817 | 9/1965 | Kostering | 221/210 |
| 3,226,070 | 12/1965 | Kurlander | 248/97 |
| 3,254,828 | 6/1966 | Lerner | 229/53 |
| 3,256,764 | 6/1966 | Hardy | 83/690 |
| 3,276,670 | 10/1966 | Harvey | 229/53 |
| 3,317,037 | 5/1967 | Russell | 206/57 |
| 3,320,843 | 5/1967 | Schott, Jr. | 83/620 |
| 3,349,991 | 10/1967 | Kessler | 229/56 |
| 3,352,411 | 11/1967 | Schwarzkopf | 206/57 |
| 3,380,579 | 4/1968 | Pinto | 206/57 |
| 3,381,886 | 5/1968 | Goglio | 229/57 |
| 3,454,441 | 7/1969 | Spruyt | 156/244 |
| 3,463,470 | 8/1969 | Green et al. | 263/40 |
| 3,468,470 | 9/1969 | Sengewald | 229/54 |
| 3,482,761 | 12/1969 | Suominen et al. | 229/54 |
| 3,485,437 | 12/1969 | Gruentzel et al. | 229/53 |
| 3,485,439 | 12/1969 | Shrum | 229/58 |
| 3,509,116 | 4/1970 | Cote et al. | 260/88.2 |
| 3,533,331 | 10/1970 | Kugler | 93/35 |
| 3,548,723 | 12/1970 | Sengewald | 93/35 |
| 3,549,451 | 12/1970 | Kugler | 156/272 |
| 3,552,697 | 1/1971 | Pinto | 248/97 |
| 3,580,486 | 5/1971 | Kugler | 229/34 |
| 3,587,382 | 6/1971 | Boyd | 83/651 |
| 3,587,844 | 6/1971 | Wing | 206/57 A |
| 3,593,622 | 7/1971 | Sengewald | 93/35 PT |
| 3,601,925 | 8/1971 | Bolling | 47/11 |
| 3,607,521 | 9/1971 | Suominen | 156/199 |
| 3,607,534 | 9/1971 | Gutman | 156/269 |
| 3,646,723 | 3/1972 | Meroney | 53/390 |
| 3,660,959 | 5/1972 | LaFleur | 53/14 |
| 3,669,347 | 6/1972 | Platz et al. | 229/58 |
| 3,670,953 | 6/1972 | Leventhal | 229/57 |
| 3,670,954 | 6/1972 | Leventhal | 229/57 |
| 3,685,643 | 8/1972 | Garshelis | 206/57 |
| 3,687,408 | 8/1972 | Lake | 248/97 |
| 3,693,192 | 9/1972 | Knotts | 4/267 |
| 3,694,524 | 9/1972 | Tinger et al. | 260/897 |
| 3,737,129 | 6/1973 | Foster | 248/97 |
| 3,739,977 | 6/1973 | Shapiro et al. | 229/55 |
| 3,747,298 | 7/1973 | Lieberman | 53/390 |
| 3,748,205 | 7/1973 | Adams | 156/252 |
| 3,758,024 | 9/1973 | Bethke et al. | 229/57 |
| 3,771,645 | 11/1973 | Wendel | 206/57 A |
| 3,782,073 | 1/1974 | Musser | 53/384 |
| 3,797,732 | 3/1974 | Melin et al. | 229/53 |
| 3,804,322 | 4/1974 | Ericson | 229/53 |
| 3,853,664 | 12/1974 | LaFleur | 156/306 |
| 3,857,329 | 12/1974 | Lehmacher et al. | 93/35 H |
| 3,865,235 | 2/1975 | Levy et al. | 206/286 |
| 3,868,891 | 3/1975 | Parish | 93/8 W |
| 3,869,065 | 3/1975 | Wang | 221/40 |
| 3,915,077 | 10/1975 | LaFleur | 93/8 R |
| 3,915,302 | 10/1975 | Farrelly et al. | 206/460 |
| 3,946,443 | 3/1976 | Knight | 2/82 |
| 3,966,524 | 6/1976 | Lehmacher | 156/182 |
| 3,970,130 | 7/1976 | Casey | 150/39 |
| 4,062,170 | 12/1977 | Orem | 53/390 |
| 4,075,290 | 2/1978 | Denzel et al. | 260/897 A |
| 4,085,822 | 4/1978 | Osborn | 186/1 |
| 4,106,734 | 8/1978 | Walitalo | 248/100 |
| 4,118,802 | 10/1978 | Polster | 2/84 |
| 4,120,716 | 10/1978 | Bonet | 156/272 |
| 4,137,958 | 2/1979 | Golby et al. | 150/1 |
| 4,147,827 | 4/1979 | Breidt, Jr. et al. | 428/218 |
| 4,151,318 | 4/1979 | Marshall | 428/35 |
| 4,164,170 | 8/1979 | Nordin | 93/35 H |
| 4,165,832 | 8/1979 | Kuklies et al. | 229/54 R |
| 4,175,602 | 11/1979 | Cavalaris et al. | 150/3 |
| 4,198,260 | 4/1980 | Mundus et al. | 156/515 |
| 4,205,021 | 5/1980 | Morita et al. | 525/240 |
| 4,262,581 | 4/1981 | Ferrell | 493/188 |
| 4,264,392 | 4/1981 | Watt | 156/272 |
| 4,268,346 | 5/1981 | Achelpohl | 156/510 |
| 4,305,558 | 12/1981 | Baker | 248/100 |
| 4,313,229 | 2/1982 | Villafañe | 2/84 |
| 4,316,353 | 2/1982 | Suominen | 53/384 |
| 4,326,664 | 4/1982 | Benoit et al. | 229/54 R |
| 4,332,361 | 6/1982 | McClellan | 248/95 |
| 4,340,379 | 7/1982 | Williamson | 493/211 |
| 4,346,834 | 8/1982 | Mazumdar | 229/54 R |
| 4,365,716 | 12/1982 | Watt | 206/632 |
| 4,367,841 | 1/1983 | Mazumdar | 229/54 R |
| 4,368,765 | 1/1983 | Larkin et al. | 150/1 |
| 4,378,268 | 3/1983 | Lehmacher | 156/558 |
| 4,388,924 | 6/1983 | Weissman et al. | 128/303 |
| 4,390,096 | 6/1983 | Goldenberg | 206/390 |
| 4,401,427 | 8/1983 | Benoit et al. | 493/199 |
| 4,406,371 | 9/1983 | Membrino | 206/554 |
| 4,407,474 | 10/1983 | Swenson | 248/97 |
| 4,417,670 | 11/1983 | Booher | 221/210 |
| 4,437,634 | 3/1984 | Hambleton | 248/97 |
| 4,458,867 | 7/1984 | Malik | 248/97 |
| 4,461,441 | 7/1984 | Briggs | 248/100 |
| 4,464,157 | 8/1984 | Benoit et al. | 493/211 |
| 4,476,979 | 10/1984 | Reimann et al. | 206/554 |
| 4,480,750 | 11/1984 | Dancy | 206/554 |
| 4,487,388 | 12/1984 | Provan | 248/97 |

| | | | |
|---|---|---|---|
| 4,491,959 | 1/1985 | Loefberg | 383/103 |
| 4,493,419 | 1/1985 | Prader et al. | 206/554 |
| 4,508,222 | 4/1985 | Choe | 206/390 |
| 4,526,639 | 7/1985 | Reimann | 156/182 |
| 4,529,087 | 7/1985 | Neal et al. | 206/328 |
| 4,529,090 | 7/1985 | Pilon | 206/554 |
| 4,538,783 | 9/1985 | Stobbe | 248/99 |
| 4,541,228 | 9/1985 | Petersen | 53/572 |
| 4,554,192 | 11/1985 | Benoit | 428/35 |
| 4,557,384 | 12/1985 | Membrino | 206/554 |
| 4,560,067 | 12/1985 | Reimann | 206/554 |
| 4,562,925 | 1/1986 | Pistner | 206/554 |
| 4,571,235 | 2/1986 | Benoit | 493/195 |
| 4,578,814 | 3/1986 | Skamser | 383/99 |
| 4,581,007 | 4/1986 | Kamp | 493/264 |
| 4,588,392 | 5/1986 | Maddock | 493/200 |
| 4,597,103 | 6/1986 | Hoover | 383/120 |
| 4,597,749 | 7/1986 | O'Brien et al. | 493/226 |
| 4,604,084 | 8/1986 | Pistner | 493/226 |
| 4,604,927 | 8/1986 | Reimann | 83/55 |
| 4,613,988 | 9/1986 | Maddock | 383/8 |
| 4,623,111 | 11/1986 | Prader | 248/97 |
| 4,652,253 | 3/1987 | Benoit | 493/195 |
| 4,655,737 | 4/1987 | Benoit | 494/194 |
| 4,670,083 | 6/1987 | Membrino | 156/510 |
| 4,676,284 | 6/1987 | DeCrane | 141/114 |
| 4,676,378 | 6/1987 | Baxley et al. | 206/554 |
| 4,699,608 | 10/1987 | Pistner | 493/204 |
| 4,704,101 | 11/1987 | Schirmer | 493/195 |
| 4,720,872 | 1/1988 | Kaczerwaski | 383/8 |
| 4,735,602 | 4/1988 | DeBin | 493/204 |
| 4,744,200 | 5/1988 | Benoit, Jr. et al. | 53/447 |
| 4,759,742 | 7/1988 | Achelpohl | 493/195 |
| 4,783,178 | 11/1988 | Herder | 383/120 |
| 4,783,856 | 11/1988 | Bouwens et al. | 2/87 |
| 4,785,938 | 11/1988 | Benoit, Jr. et al. | 206/554 |
| 4,786,275 | 11/1988 | Hoover | 493/194 |
| 4,790,437 | 12/1988 | Pistner | 206/554 |
| 4,796,126 | 1/1989 | Tsuchiya et al. | 360/103 |
| 4,796,759 | 1/1989 | Schisler | 206/554 |
| 4,811,417 | 3/1989 | Prince et al. | 383/9 |
| 4,812,055 | 3/1989 | Prader et al. | 383/119 |
| 4,816,104 | 3/1989 | Benoit | 156/204 |
| 4,819,806 | 4/1989 | Pistner | 206/554 |
| 4,819,898 | 4/1989 | Benoit et al. | 248/97 |
| 4,830,317 | 5/1989 | Kober et al. | 248/97 |
| 4,840,610 | 6/1989 | Pistner | 493/194 |
| 4,854,999 | 8/1989 | Schirmer | 156/272 |
| 4,877,473 | 10/1989 | Snowdon et al. | 156/204 |
| 4,883,450 | 11/1989 | Benoit | 493/196 |
| 4,913,561 | 4/1990 | Beer | 383/94 |
| 4,921,197 | 5/1990 | Benoit et al. | 248/97 |
| 4,989,732 | 2/1991 | Smith | 206/554 |
| 4,995,860 | 2/1991 | Wilfong | 493/195 |
| 5,014,582 | 5/1991 | Teik | 83/24 |
| 5,020,750 | 6/1991 | Vrooman et al. | 248/97 |
| 5,062,927 | 11/1991 | Stout | 203/89 |
| 5,087,234 | 2/1992 | Prader et al. | 493/194 |
| 5,149,201 | 9/1992 | Benoit | 383/8 |
| 5,183,158 | 2/1993 | Boyd et al. | 206/554 |
| 5,219,220 | 6/1993 | Kucera et al. | 383/120 |
| 5,333,730 | 8/1994 | Boyd | 206/554 |
| 5,421,803 | 6/1995 | Kemanjian | 493/198 |
| 5,465,845 | 11/1995 | Norby et al. | 206/554 |
| 5,484,376 | 1/1996 | Prader et al. | 493/194 |
| 5,507,713 | 4/1996 | Glod, Sr. et al. | 493/194 |
| 5,573,489 | 11/1996 | Letendre et al. | 493/194 |
| 5,630,779 | 5/1997 | Glod et al. | 493/194 |
| 5,669,504 | 9/1997 | Leone et al. | 206/554 |

FOREIGN PATENT DOCUMENTS

| | | |
|---|---|---|
| 1008293 | 10/1965 | United Kingdom . |
| 1035887 | 7/1966 | United Kingdom . |
| 1231686 | 5/1971 | United Kingdom . |
| 1275399 | 5/1972 | United Kingdom . |
| 2071063A | 9/1981 | United Kingdom . |
| 2159493A | 12/1985 | United Kingdom . |
| WO84/00322 | 2/1984 | WIPO . |

EASY TO OPEN HANDLE BAG AND METHOD OF MAKING THE SAME

FIELD OF THE INVENTION

The present invention relates generally to the field of thermoplastic bags. More particularly, it concerns thermoplastic handle bags having a T-shirt configuration.

BACKGROUND OF THE INVENTION

For many years, thermoplastic bags have been widely used for a number of household and industrial purposes. Many bags have a simple rectangular structure comprising two layers of thermoplastic film heat sealed at the bag bottom, folded sides and an open top. This simple structure has been adapted to form a wide variety of sizes and configurations that vary with the intended uses of the bags.

In recent years, bag manufacturers have developed new types of thermoplastic bags such as, for example, draw tape bags, handle bags, and bags with protruding top edges. These different bag types provide the user with different advantages such as being able to easily close, tie and/or identify a bag. However, the easy to open, use and close handle bags have traditionally required expensive and complicated manufacturing procedures. Furthermore, handle bag manufacturers have experienced cost reduction pressure from other products and, as a result of their cost reduction efforts, new product configurations have been developed. These new handle bag configurations have decreased the manufacturing costs of the product but have also made the resulting bags more difficult to open and use.

For example, one existing low cost handle bag configuration is produced by starting with a thin thermoplastic film tube that is transversely heat sealed to form individual bags. The edges of tube are then longitudinally folded inward so that the edges are adjacent to the middle of the bag. The tube is then folded again about its middle thereby forming four overlapped bag sections comprising eight layers of thermoplastic material. A corner of the bag is then removed to form the handles and bag mouth. Such a manufacturing process is described and illustrated in U.S. Pat. No. 4,790,437.

However, the above described manufacturing process makes the resulting handle bag difficult and time consuming to use. A user must unfold the second middle fold and then the first quarter folds in sequence before being able to open the bag.

Consequently, these deficiencies have created a need for an inexpensive and efficient method of manufacturing handle bags that are easy to open, use and close.

SUMMARY OF THE INVENTION

In accordance with one aspect of the present invention, there is provided a low cost method of forming handle bags that are easy and less time consuming to open, use and close.

In accordance with another aspect of the present invention, there is provided a handle bag that is easy to open, use and close.

In accordance with yet another aspect of the present invention, there is provided a method that involves less folding than prior methods to form a handle bag.

These and other objects of the invention are provided by a method of forming a plurality of easy to open handle bags including the steps of providing a flattened tube of thermoplastic material oriented in a generally longitudinal direction. The flattened tube has a first longitudinal side edge and a second longitudinal side edge, a transverse lower heat seal, and a transverse upper heat seal. The tube also has first, second, and third sections. The second section being disposed between the first and third sections. The first section is joined to the second section along a generally longitudinal first fold line. The second section is joined to the third section along a generally longitudinal second fold line. The second section is cut along a generally transverse first cut line extending between the first and second fold lines. The first section is folded over the second section along the first fold line. The third section is folded over the previously folded-over first section along the second fold line such that the first, second, and third sections overlap one another. The overlapped first, second, and third sections are cut along a generally longitudinal second cut line that intersects the first cut line, the first fold line, and the second side edge at one end and intersects the upper heat seal at the other end. The overlapped first, second, and third sections are then cut along a generally longitudinal third cut line that intersects the first cut line, the second fold line, and the first side edge at one end and intersects the upper heat seal at the other end.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DESCRIPTION OF ILLUSTRATIVE EMBODIMENTS

Figure 1:
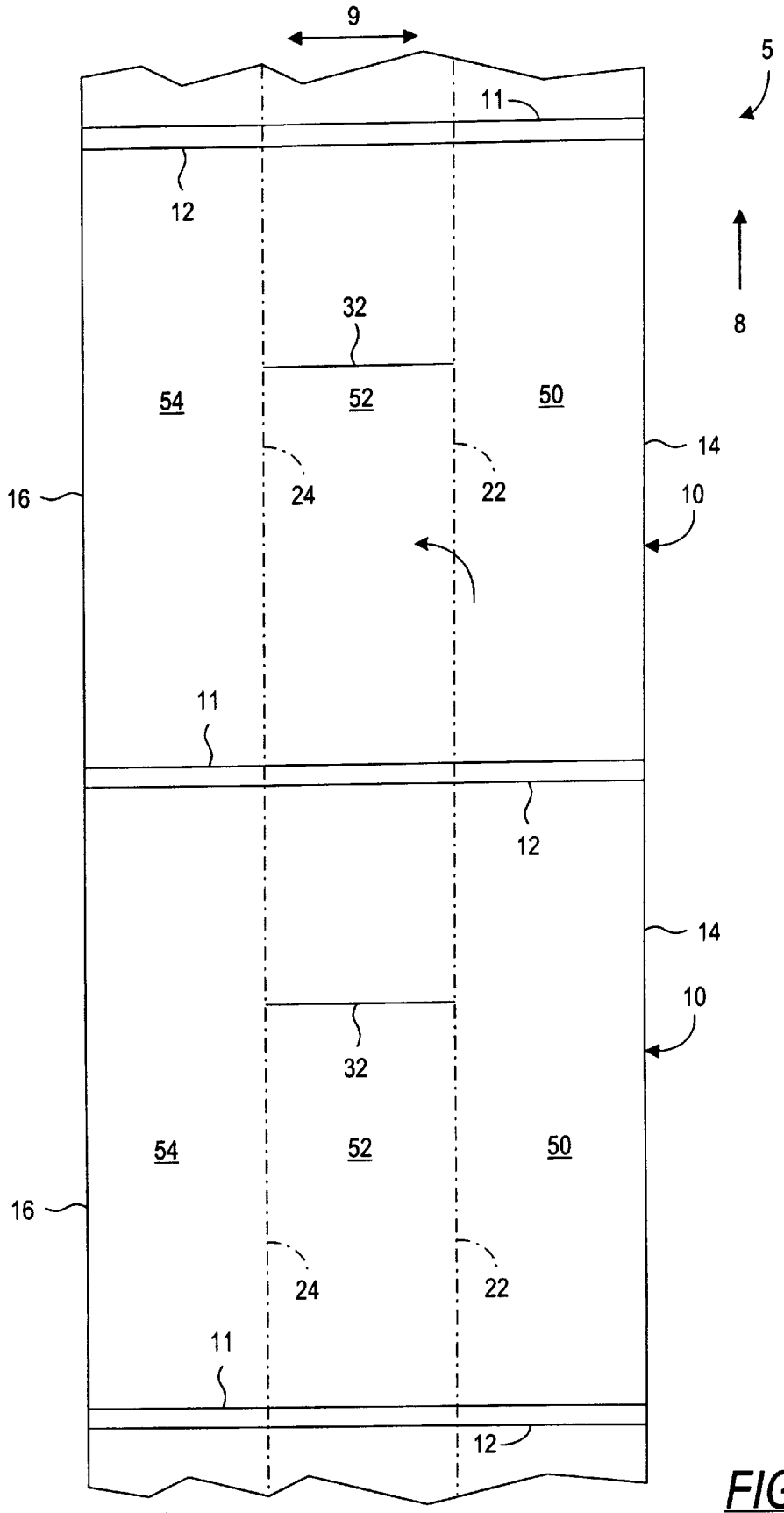
FIG. 1 is a plan view of a collapsed thermoplastic tube.

Referring now to the drawings, and more particularly to FIG. 1, there is shown a collapsed thermoplastic tube 5 traveling in a longitudinal direction 8. The collapsed tube 5 includes an opposing top and bottom layer of thermoplastic film. Each opposing layer may comprise one or more layers of thermoplastic material. The transverse direction 9 is generally perpendicular to the longitudinal direction 8 in which the thermoplastic tube 5 moves. The thermoplastic material used can be any thermoplastic material well known to one of ordinary skill in the art and as more specifically detailed herein below. The tube 5 includes a plurality of interconnected bag forming segments 10. Each bag forming segment 10 includes a pair of opposing longitudinal side edges 14 and 16. Adjacent bag forming segments 10 are separated from each other by transverse heat seals 11 and 12. Each bag forming segment 10 comprises a first, second and third section 50, 52 and 54, respectively. The second section 52 is disposed between the first section 50 and the third section 54. The first section 50 is joined to the second section 52 along a generally longitudinal first fold line 22. The second section 52 is joined to the third section 54 along a generally longitudinal second fold line 24.

The method of forming a plurality of interconnected handle bags begins by forming a transverse lower heat seal 11 and a transverse upper heat seal 12 for each bag forming segment 10. To form the heat seals 11 and 12, the tube 5 travels through a sealing station where pairs of transverse heat seals 11 and 12 are formed across the tube 5. The opposing thermoplastic layers of the tube 5 are thermally fused to each other along the heat seals 11 and 12 at about bag-length distances apart. Alternatively, one broad heat seal may replace the heat seals 11 and 12. This broad heat seal may then either be perforated or severed, as described below, to produce the same results described herein.

Figure 2A:
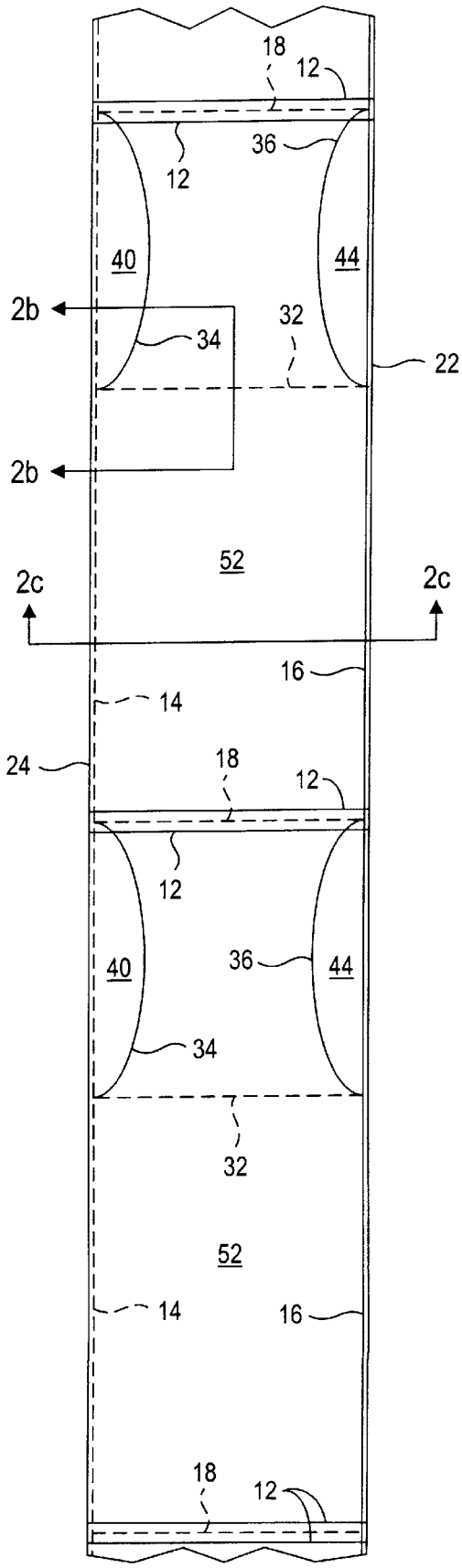
FIG. 2*a* is a plan view of the tube of FIG. 1 after it has been folded in thirds.

The method proceeds by cutting the second section 52 along a generally transverse first cut line 32 that extends between the first fold line 22 and the second fold line 24. The tube 5 is cut at a cutting station that includes a cutting instrument that operates to sever both layers of the tube 5 at cut line 32. Referring now to FIGS. 1 and 2*a*, the method continues by longitudinally folding the first section 50 over the second section 52 along the first fold line 22. Then, the third section 54 is folded over the folded-over first section 50 along the second fold line 24 such that the first, second, and third sections 50, 52 and 54, overlap one another and comprise a total of six layers of thermoplastic material.

Referring now to FIG. 2*a*, the bag forming segments 10 are weakened between the heat seals 11 and 12 at line of weakness 18. The transverse lines of weakness 18 are created between the upper heat seal 11 of one segment and the lower heat seal 12 of an adjacent segment to form separable bags and to facilitate removal of sections 40, 42 and 44, as described below. The lines of weakness 18 may be in the form of perforations, thinned lines, scored lines, etc.

Figure 2B:
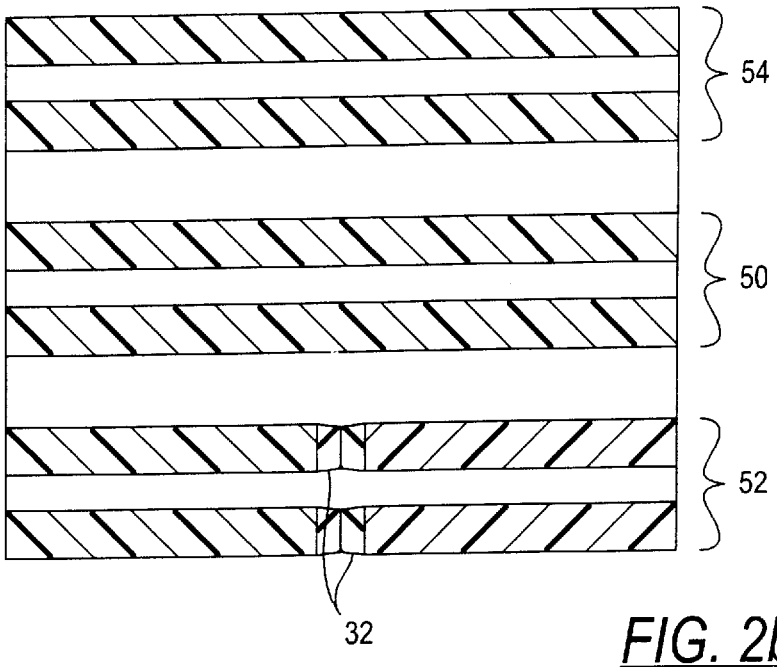
FIG. 2*b* is a cross-sectional view taken along line 2*b*–2*b* in FIG. 2*a* showing a portion of the collapsed tube and a transverse cut.
Figure 2C:
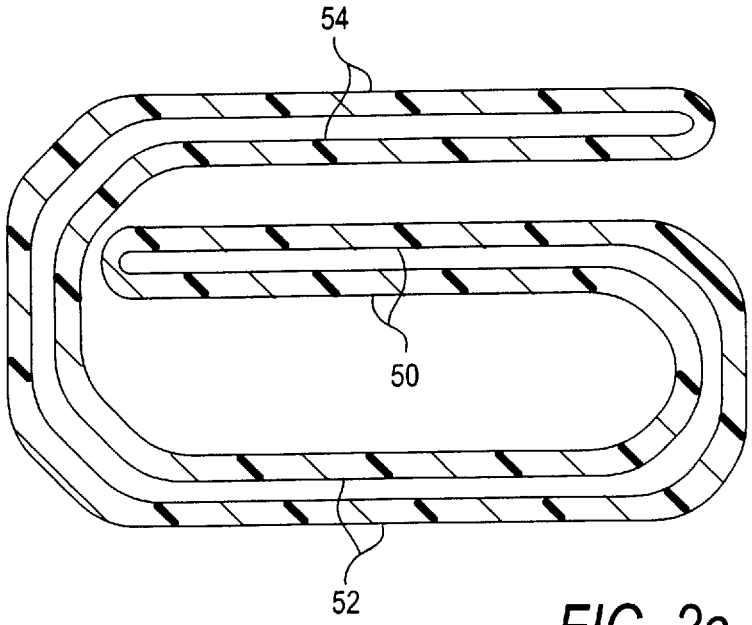
FIG. 2*c* is a cross-sectional view taken along line 2*c*–2*c* in FIG. 2*a* showing how the collapsed tube is folded.

FIGS. 2*b* and 2*c* illustrate cross-sectional views of the tube 5. FIG. 2*b* illustrates sections 50, 52 and 54 and the transverse cut 32 while FIG. 2*c* illustrates how the tube 5 is folded.

Figure 3:
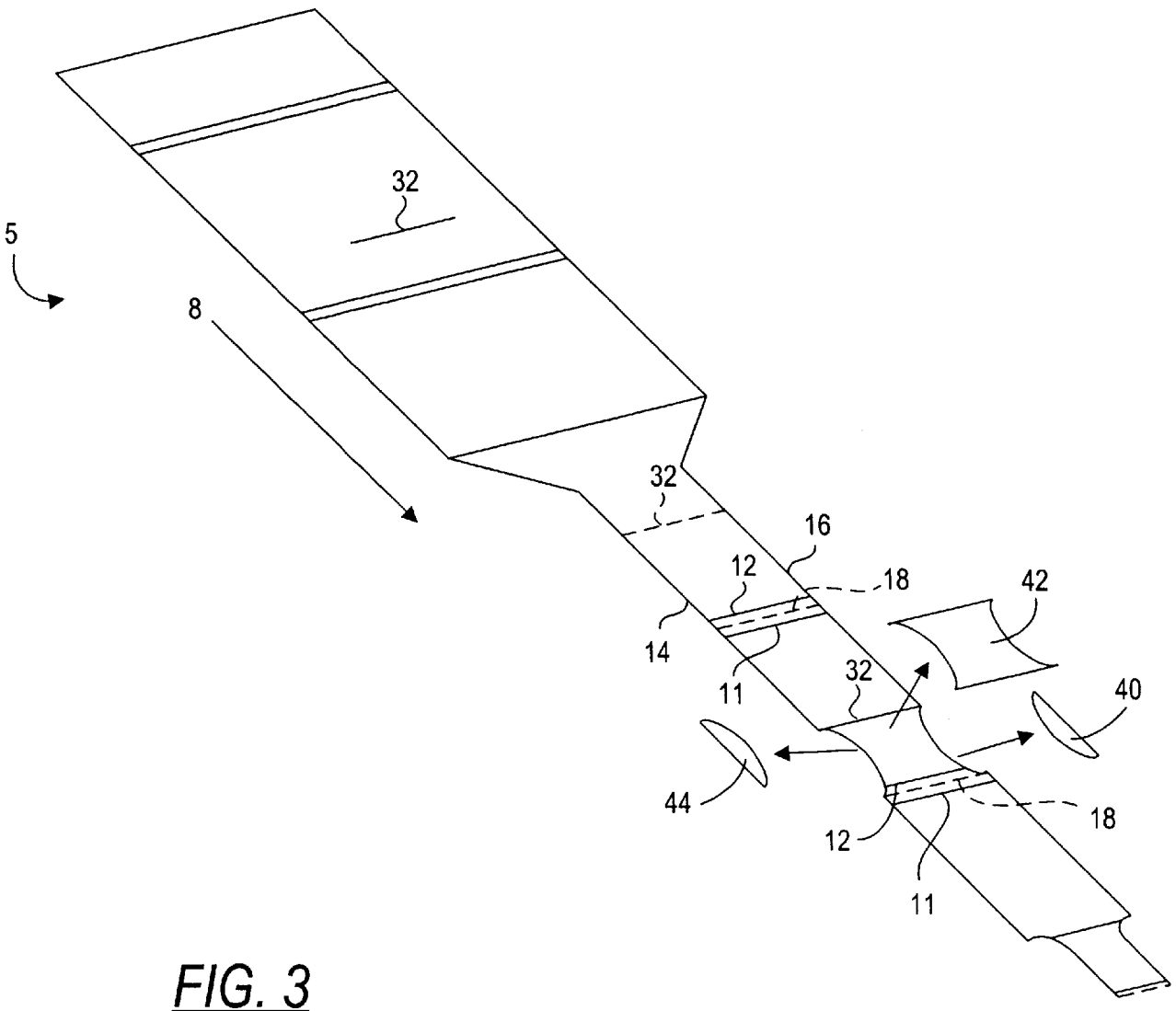
FIG. 3 is a perspective view of the tube of FIG. 1 being folded into the tube of FIG. 2*a*.
Figure 4:
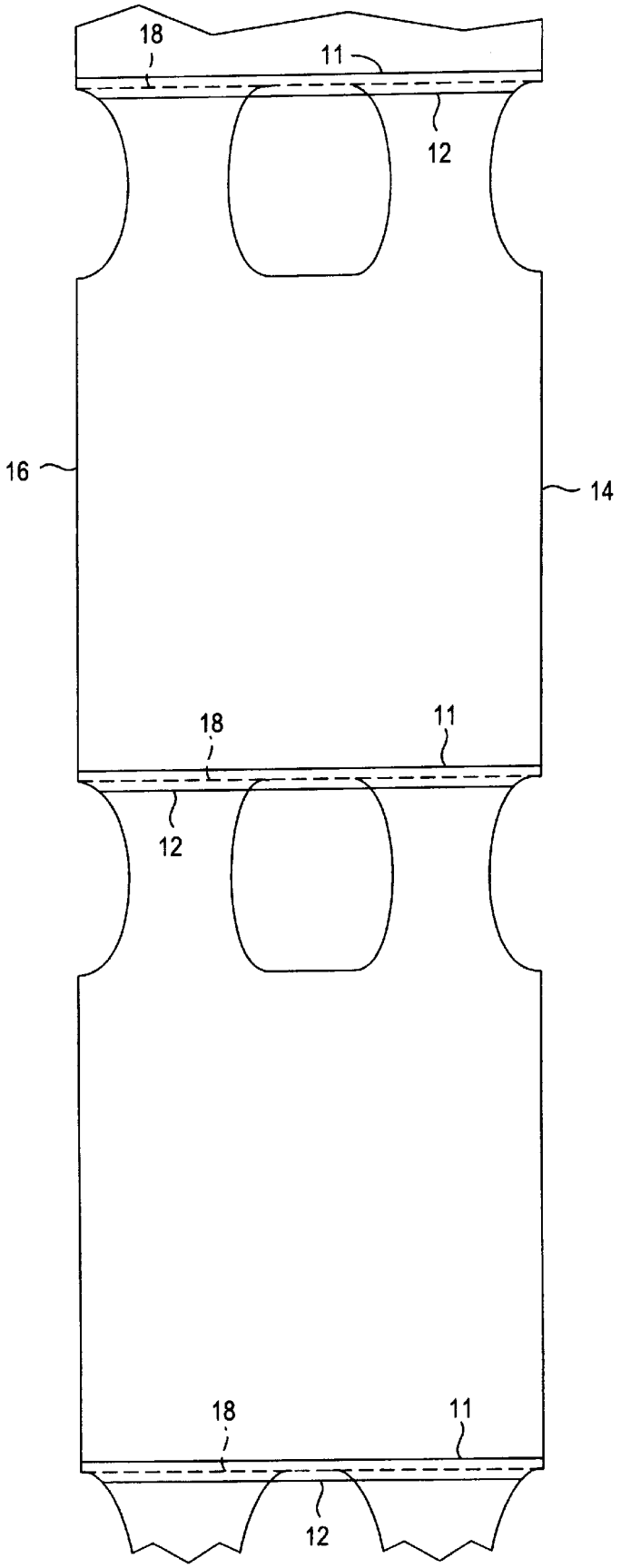
FIG. 4 is a plan view of the tube of FIG. 2*a* after it has been unfolded.

Referring now to FIGS. 2*a* and 3, a second cutting station cuts the overlapped first, second, and third sections 50, 52 and 54 along a generally longitudinal second cut line 36 that intersects the first cut line 32, the first fold line 22, and the second side edge 16 at one end and intersects the upper line of weakness 18 at the other end. Next, the second cutting station cuts the overlapped first, second, and third sections 50, 52 and 54 along a generally longitudinal third cut line 34 that intersects the first cut line 32, the second fold line 24, and the first side edge 14 at one end and intersects the upper line of weakness 18 at the other end. Sections 40, 42 and 44 are then removed, as illustrated in FIG. 3, to form a plurality of interconnected handle bags 10. Removed sections 40 and 44 include six layers of thermoplastic material. Removed section 42 includes only two layers of thermoplastic material corresponding to section 52 of the unfolded bag 10 illustrated in FIG. 1. Cut line 32 is shown in phantom in the bottom part of FIG. 3 because cut line 32 is in section 52 which is obstructed from this view by folded over sections 50 and 54. FIG. 4 illustrates the plurality of interconnected handle bags 10 after they are unfolded and laid flat.

Thus, the method of the present invention provides a plurality of longitudinally folded and interconnected handle bags 10. In one embodiment, the bags 10 are then wound onto a roll for packaging. In another embodiment, the bags 10 are severed into individual bags, folded transversely and stacked for packaging. In yet another embodiment, each bag 10 is first folded transversely and then severed from the interconnected bags and stacked for packaging. The above methods provide a handle bag that is easy to open, use and close thus saving the user time and preventing frustration.

The thermoplastic materials suitable for the present invention include high density and low density polyethylenes. Particularly preferred is linear low density polyethylene (LLDPE). LLDPE is an ethylenic copolymer formed by copolymerizing ethylene with a minor proportion by weight of an alpha olefin monomer containing 4 to 10 carbon atoms. The use of LLDPE in garbage bags has permitted manufacturers to increase strength, puncture resistance, and tear resistance properties. By way of example, and not intended to limit the scope of the present invention, typical film thicknesses used for bags of the present invention are from about 0.3 mil to about 1.5 mil.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method of forming an easy to open handle bag, comprising the steps of:

providing a flattened tube of thermoplastic material oriented in a generally longitudinal direction, said flattened tube having a first longitudinal side edge and a second longitudinal side edge, a transverse lower heat seal, and a transverse upper heat seal, the tube having first, second, and third sections, the second section being disposed between the first and third sections, the first section being joined to the second section along a generally longitudinal first fold line, the second section being joined to the third section along a generally longitudinal second fold line;

cutting the second section along a first cut line generally transverse to and extending between the first and second fold lines;

folding the first section over the second section along the first fold line;

folding the third section over the folded-over first section along the second fold line such that the first, second, and third sections overlap one another;

cutting the overlapped first, second, and third sections along a generally longitudinal second cut line intersecting the first cut line, the first fold line, and the second side edge at one end and intersecting the upper heat seal at the other end; and cutting the overlapped first, second, and third sections along a generally longitudinal third cut line intersecting the first cut line, the second fold line, and the first side edge at one end and intersecting the upper heat seal at the other end.

2. A method of forming a plurality of interconnected bag segments each having handles, the method comprising the steps of:

providing a flattened tube of thermoplastic material oriented in a generally longitudinal direction and comprised of the plurality of interconnected bag segments, each bag segment having a first longitudinal side edge and a second longitudinal side edge, a transverse lower heat seal, and a transverse upper heat seal, the tube having first, second, and third sections, the second section being disposed between the first and third sections, the first section being joined to the second section along a generally longitudinal first fold line, the second section being joined to the third section along a generally longitudinal second fold line;

forming an upper line of weakness between the transverse upper heat seal of one segment and the transverse lower heat seal of an adjacent segment;

cutting the second section along a generally transverse first cut line extending between the first and second fold lines;

folding the first section over the second section along the first fold line;

folding the third section over the folded-over first section along the second fold line such that the first, second, and third sections overlap one another;

cutting the overlapped first, second, and third sections along a generally longitudinal second cut line intersecting the first cut line, the first fold line, and the second side edge at one end and intersecting the upper line of weakness at the other end;

cutting the overlapped first, second, and third sections along a generally longitudinal third cut line intersecting the first cut line, the second fold line, and the first side edge at one end and intersecting the upper line of weakness at the other end; and removing sections of the tube formed by the first, second and third cut lines to provide the bag segments with handles.

3. The method of claim 1, wherein the second cut line intersects both the upper heat seal and the first fold line at the other end, and wherein the third cut line intersects both the upper heat seal and the second fold line at the other end.

4. The method of claim 3, wherein the second and third cut lines form respective parabolic, removable sections.

5. The method of claim 4, wherein the removable sections comprise six layers of thermoplastic material.

6. The method of claim 1, wherein the one end of the second cut line is located at an intersection of the first cut line and the first fold line and the other end of the second cut line is located at an intersection of the upper heat seal and the first fold line, and wherein the one end of the third cut line is located at an intersection of the first cut line and the second fold line and the other end of the third cut line is located at an intersection of the upper heat seal and the second fold line.

7. The method of claim 1, wherein the one end of the second cut line is located at an intersection of the first cut line and the first fold line, and wherein the one end of the third cut line is located at an intersection of the first cut line and the second fold line.

8. The method of claim 1, wherein the first, second, and third sections are approximately equal in area.

9. The method of claim 1, wherein the second and third cut lines are generally arc shaped.

10. The method of claim 1, wherein the second and third cut lines create handles for the bag.

11. The method of claim 10, wherein the first cut line creates an empty gap between the handles.

12. The method of claim 11, wherein the empty gap is formed by the removal of two layers of thermoplastic material from the second section.

13. The method of claim 1, wherein the second and third cut lines form two respective circle segments that are removable.

14. The method of claim 1, wherein the tube is comprised of two opposing layers of thermoplastic material.

15. The method of claim 1, wherein the first, second and third sections are each comprised of two layers of thermoplastic material.

16. The method of claim 1, wherein the overlapped first, second and third sections comprise a total of six layers of thermoplastic material.

17. A method of forming a plurality of interconnected bag segments each having handles, the method comprising the steps of:

providing a flattened tube of thermoplastic material oriented in a generally longitudinal direction and comprised of the plurality of interconnected bag segments, each bag segment having a first longitudinal side edge and a second longitudinal side edge, a transverse lower heat seal, and a transverse upper heat seal, the tube having first, second, and third sections, the second section being disposed between the first and third sections, the first section being joined to the second section along a generally longitudinal first fold line, the second section being joined to the third section along a generally longitudinal second fold line;

forming an upper line of weakness between the transverse upper heat seal of one segment and the transverse lower heat seal of an adjacent segment;

cutting the second section along a generally transverse first cut line extending between the first and second fold lines;

folding the first section over the second section along the first fold line;

folding the third section over the folded-over first section along the second fold line such that the first, second, and third sections overlap one another;

cutting the overlapped first, second, and third sections along a generally longitudinal second cut line intersecting the first cut line, the first fold line, and the second side edge at one end and intersecting the upper line of weakness at the other end;

cutting the overlapped first, second, and third sections along a generally longitudinal third cut line intersecting the first cut line, the second fold line, and the first side edge at one end and intersecting the upper line of weakness at the other end; and removing sections of the tube formed by the first, second and third cut lines to provide the bag segments with handles.

18. The method of claim 17 further comprising the step of:

winding the plurality of interconnected segments into a roll.

19. The method of claim 17 further comprising the steps of:

separating the plurality of interconnected segments;

transversely folding the segments; and stacking the folded segments for packaging.

20. The method of claim 19, wherein the step of transversely folding the segments occurs prior to the step of separating the segments.

21. The method of claim 17 wherein the tube is comprised of opposing top and bottom layers of thermoplastic material.

22. The method of claim 17, wherein the first cut line is generally linear.

23. The method of claim 17, wherein the second cut line intersects both the upper line of weakness and the first fold line at the other end, and wherein the third cut line intersects both the upper line of weakness and the second fold line at the other end.

24. The method of claim 23, wherein the second and third cut lines form respective parabolic, removable sections.

25. The method of claim 24, wherein the removable sections comprise six layers of thermoplastic material.

26. The method of claim 17, wherein the one end of the second cut line is located at an intersection of the first cut line and the first fold line and the other end of the second cut line is located at an intersection of the upper line of weakness and the first fold line, and wherein the one end of the third cut line is located at an intersection of the first cut line and the second fold line and the other end of the third cut line is located at an intersection of the upper line of weakness and the second fold line.

27. The method of claim 17, wherein the one end of the second cut line is located at an intersection of the first cut line and the first fold line, and wherein the one end of the third cut line is located at an intersection of the first cut line and the second fold line.

28. The method of claim 17, wherein the first, second, and third sections are approximately equal in area.

29. The method of claim 17, wherein the second and third cut lines are generally arc shaped.

30. The method of claim 17, wherein the second and third cut lines create a pair of handles for each of the plurality of interconnected segments.

31. The method of claim 30, wherein the first cut line creates an empty gap between the handles.

32. The method of claim 31, wherein the empty gap is formed by the removal of two layers of thermoplastic material from the second section.

33. The method of claim 17, wherein the second and third cut lines form two respective circle segments that are removable.

34. The method of claim 17, wherein the first, second and third sections are each comprised of two layers of thermoplastic material.

35. The method of claim 17, wherein the overlapped first, second and third sections comprise a total of six layers of thermoplastic material.

36. The method of claim 17, wherein the upper heat seal of the one segment and the lower heat seal of the adjacent segment are part of one broad heat seal.

37. A method of forming an easy to open handle bag, comprising the steps of:

providing a flattened tube of thermoplastic material oriented in a generally longitudinal direction, said flattened tube having a first longitudinal side edge and a second longitudinal side edge, a transverse lower heat seal, and a transverse upper heat seal, the tube having first, second, and third sections, the second section being disposed between the first and third sections, the first section being joined to the second section along a generally longitudinal first fold line, the second section being joined to the third section along a generally longitudinal second fold line;

cutting the second section along a first cut line generally transverse to and extending between the first and second fold lines;

folding the first section over the second section along the first fold line;

folding the third section over the folded-over first section along the second fold line such that the first, second, and third sections overlap one another, the overlapped first, second and third sections comprising a total of six layers of thermoplastic material;

cutting the overlapped first, second, and third sections along a generally longitudinal second cut line intersecting the first cut line, the first fold line, and the second side edge at one end and intersecting the upper heat seal at the other end; and cutting the overlapped first, second, and third sections along a generally longitudinal third cut line intersecting the first cut line, the second fold line, and the first side edge at one end and intersecting the upper heat seal at the other end.

38. A method of forming an easy to open handle bag, comprising the steps of:

providing a flattened tube of thermoplastic material oriented in a generally longitudinal direction, said flattened tube having a first longitudinal side edge and a second longitudinal side edge, a transverse lower heat seal, and a transverse upper heat seal, the tube having first, second, and third sections, the second section being disposed between the first and third sections, the first section being joined to the second section along a generally longitudinal first fold line, the second section being joined to the third section along a generally longitudinal second fold line;

cutting the second section along a first cut line generally transverse to and extending between the first and second fold lines;

folding the first section over the second section along the first fold line;

folding the third section over the folded-over first section along the second fold line such that the first, second, and third sections overlap one another, the overlapped first, second and third sections comprising a total of six composite layers of thermoplastic material, each composite layer of thermoplastic material comprising one or more sub-layers of thermoplastic material;

cutting the overlapped first, second, and third sections along a generally longitudinal second cut line intersecting the first cut line, the first fold line, and the second side edge at one end and intersecting the upper heat seal at the other end; and cutting the overlapped first, second, and third sections along a generally longitudinal third cut line intersecting the first cut line, the second fold line, and the first side edge at one end and intersecting the upper heat seal at the other end.

* * * * *